US009548061B2

(12) United States Patent
Schildbach

(10) Patent No.: US 9,548,061 B2
(45) Date of Patent: Jan. 17, 2017

(54) AUDIO ENCODER WITH PARALLEL ARCHITECTURE

(71) Applicant: DOLBY INTERNATIONAL AB, Amsterdam (NL)

(72) Inventor: Wolfgang Schildbach, Nuremberg (DE)

(73) Assignee: Dolby International AB, Amsterdam (NL)

( * ) Notice: Subject to any disclaimer, the term of this patent is extended or adjusted under 35 U.S.C. 154(b) by 163 days.

(21) Appl. No.: 14/367,447

(22) PCT Filed: Dec. 11, 2012

(86) PCT No.: PCT/EP2012/075056

§ 371 (c)(1),
(2) Date: Jun. 20, 2014

(87) PCT Pub. No.: WO2013/092292

PCT Pub. Date: Jun. 27, 2013

(65) Prior Publication Data

US 2015/0025895 A1 Jan. 22, 2015

Related U.S. Application Data

(60) Provisional application No. 61/578,376, filed on Dec. 21, 2011.

(51) Int. Cl.
*G10L 19/00* (2013.01)
*G10L 19/16* (2013.01)
(Continued)

(52) U.S. Cl.
CPC ..... *G10L 19/16* (2013.01); *G10L 19/022* (2013.01); *G10L 19/032* (2013.01)

(58) Field of Classification Search
CPC ..... G10L 19/035; G10L 19/008; G10L 19/02; G10L 19/032; G10L 19/025; G10L 19/002; G10L 25/78; G10L 19/20; G10L 19/06
(Continued)

(56) References Cited

U.S. PATENT DOCUMENTS 6,567,781 B1 5/2003 Lafe
6,690,726 B1 2/2004 Yavits
(Continued)

FOREIGN PATENT DOCUMENTS

CN 101350199 1/2009
EP 1793372 6/2007
(Continued)

OTHER PUBLICATIONS

Balevic, A. et al "Using Arithmetic Coding for Reduction of Resulting Simulation Data Size on Massively Parallel GPGPUs" 15th European PVM/MPI User's Group Meeting, Sep. 7-10, 2008.
(Continued)

*Primary Examiner* — Huyen Vo

(57) ABSTRACT

The present document relates to methods and systems for audio encoding. In particular, the present document relates to methods and systems for fast audio encoding using a parallel system architecture. A frame-based audio encoder (300, 400, 500, 600) comprising K parallel transform units (303, 403) is described; wherein each of the K parallel transform units (303, 403) is configured to transform a respective one of a group of K frames (305) of an audio signal (101) into a respective one of K sets of frequency coefficients; wherein K>1; wherein each of the K frames (305) comprises a plurality of samples of the audio signal (101).

20 Claims, 6 Drawing Sheets

(51) Int. Cl.
*G10L 19/022* (2013.01)
*G10L 19/032* (2013.01)

(58) Field of Classification Search
USPC ..... 704/500–504, 222, 227–230, 205, 208
See application file for complete search history.

(56) References Cited

U.S. PATENT DOCUMENTS

| | | | | |
|---|---|---|---|---|
| 7,418,394 | B2 | 8/2008 | Cowdery | |
| 7,676,647 | B2 | 3/2010 | Codrescu | |
| 2001/0033699 | A1 | 10/2001 | Eshraghian | |
| 2004/0024592 | A1 | 2/2004 | Matsunuma | |
| 2004/0225495 | A1* | 11/2004 | Makino | G10L 19/008 704/229 |
| 2008/0027715 | A1* | 1/2008 | Rajendran | G10L 19/06 704/205 |
| 2008/0040120 | A1* | 2/2008 | Kurniawati | G10L 19/002 704/500 |
| 2009/0154690 | A1 | 6/2009 | Wu | |
| 2009/0259829 | A1 | 10/2009 | Grover | |
| 2010/0088356 | A1 | 4/2010 | Lloyd | |
| 2010/0145688 | A1* | 6/2010 | Sung | G10L 19/20 704/208 |
| 2011/0087345 | A1 | 4/2011 | Chan | |
| 2011/0178795 | A1* | 7/2011 | Bayer | G10L 19/002 704/205 |

FOREIGN PATENT DOCUMENTS

| | | |
|---|---|---|
| EP | 1973372 | 9/2008 |
| JP | 3171598 | 5/2001 |
| JP | 2001-242894 | 9/2001 |
| JP | 2002-014696 | 1/2002 |
| JP | 2004-069773 | 3/2004 |
| JP | 2007-212895 | 8/2007 |
| JP | 2008-539462 | 11/2008 |

OTHER PUBLICATIONS

FLACCL from CUETOOLS, last modified in Jun. 2011.

Shikano, H. et al "Heterogenous Multi-Core Architecture That Enables 54x AAC-LC Stereo Encoding" IEEE Journal of Solid-State Circuits, vol. 43, No. 4, Apr. 2008, pp. 902-910.

Savioja, L. et al "Audio Signal Processing Using Graphics Processing Units" JAES vol. 59 Issue pp. 3-19, Jan. 2011.

Mason, A. J. "Implementations of an MPEG 2 Layer IIII Multichannel Audio Encoder Running in Real Time" International Broadcasting Convention, London, UK, Sep. 12-16, 1996, pp. 460-465.

* cited by examiner

AUDIO ENCODER WITH PARALLEL ARCHITECTURE

CROSS REFERENCE TO RELATED APPLICATIONS

This application claims priority to U.S. Provisional Patent Application No. 61/565,037 filed 30 Nov. 2011, hereby incorporated by reference in its entirety.

TECHNICAL FIELD OF THE INVENTION

The present document relates to methods and systems for audio encoding. In particular, the present document relates to methods and systems for fast audio encoding using parallel encoder architecture.

BACKGROUND OF THE INVENTION

Today's media players support various different audio formats such as mp3, mp4, WMA (Windows Media Audio), AAC (Advanced Audio Coding), HE-AAC (High Efficiency AAC) etc. On the other hand, media databases (such as Simfy) provide millions of audio files for download. Typically, it is not economical to encode and store these millions of audio files in the various different audio formats and the various different bit-rates that may be supported by the different media players. As such, it is beneficial to provide fast audio encoding schemes which enable encoding of audio files "on the fly", thereby enabling media databases to generate a particularly encoded audio file (in a particular audio format, at a particular bit-rate) as and when it is requested.

SUMMARY OF THE INVENTION

According to an aspect, a frame-based audio encoder is described. The audio encoder may be configured to divide an audio signal comprising a plurality of time-domain samples into a sequence of frames, wherein each frame typically comprises a pre-determined number of samples. By way of example, a frame may comprise a fixed number M (e.g. M=1024) of samples. In an embodiment, the audio encoder is configured to perform Advanced Audio Coding (AAC).

The audio encoder may comprise K parallel transform units processing K frames of the audio signal (e.g. K successive frames of the audio signal) in parallel. The K parallel transform units may be implemented on K different processing units (e.g. graphical processing units), thereby accelerating the transform process by a factor of K (compared to a sequential processing of the K frames). A transform unit may be configured to transform a frame into a set of frequency coefficients. In other words, a transform unit may perform a time-domain to frequency domain transformation, such as a Modified Discrete Cosine Transform (MDCT).

As such, each of the K parallel transform units may be configured to transform a respective one of the group of K frames (also referred to as a frame group) of the audio signal into a respective one of K sets of frequency coefficients. K may be greater than 1, 2, 3, 4, 5, 10, 20, 50, 100.

As indicated above, the K parallel transform units may be configured to apply a MDCT to the K frames of the frame group, respectively. In addition, the K parallel transform units may be configured to apply a window function to the K frames of the frame group, respectively. It should be noted that the type of transform and/or the type of window applied to a frame typically depends on a type of the frame (i.e. the frame-type which is also referred to herein as the block-type). As such, the K parallel transform units may be configured to transform the K frames into K frame-type dependent sets of frequency coefficients, respectively.

The audio encoder may comprise K parallel signal-attack detection units. A signal-attack detection unit may be configured to classify a frame of the audio signal as a frame comprising an acoustic attack (e.g. a transient frame) or as a frame which does not comprise an acoustic attack (e.g. a tonal frame). As such the K parallel signal-attack detection units may be configured to classify the K frames of the frame group, respectively, based on the presence or absence of an acoustic attack within the respective one of the K frames. The K parallel signal-attack detection units may be implemented on at least K different processing units. In particular, the K parallel signal-attack detection units may be implemented on the same respective processing units as the K parallel transform units.

The audio encoder may further comprise a frame-type detection unit configured to determine a frame-type of each of the K frames based on the classification of the K frames. Examples for frame-types are a short-block type (which is typically used for frames comprising a transient audio signal), a long-block type (which is typically used for frames comprising a tonal audio signal), a start-block type (which is typically used as a transit frame from a long-block type to a short-block type) and/or a stop-type (which is typically used as a transit frame from a short-block type to a long-block type). As such, the frame-type of a frame may be dependent on the frame-type of one or more former frames. Consequently, the frame-type detection unit may be configured to determine a frame-type of a frame k, k=1, . . . , K, of the K frames also based on the frame-type of the preceding frame k−1.

By way of example, the frame-type detection unit may be configured to determine that a frame k, k=1, . . . , K, is of a short-block type if the frame k is classified as comprising an attack and if its preceding frame k−1 is of a short-block type or of a start-block type. The frame-type detection unit may be configured to determine that a frame k, k=1, . . . , K, is of a long-block type if the frame k is classified as not comprising an attack and if its preceding frame k−1 is of a long-block type or of a stop-block type. The frame-type detection unit may be configured to determine that a frame k, k=1, . . . , K, is of a start-block type if the frame k is classified as comprising an attack and if its preceding frame k−1 is of a long-block type. Furthermore, the frame-type detection unit may be configured to determine that a frame k, k=1, . . . , K, is of a stop-block type if the frame k is classified as not comprising an attack and if its preceding frame k−1 is of a short-block type.

The K parallel transform units may be operated in parallel to the K parallel signal-attack detection units and the frame-type detection unit. As such, the K parallel transform units may be implemented in different processing units than the K parallel signal-attack detection units, thereby enabling a further parallelization of the encoder on at least 2K processing units. In such cases, the transform units may be configured to perform speculative execution of the frame-type dependent windowing and/or transform processing. In particular, the transform units may be configured to determine a plurality of frame-type dependent sets of frequency coefficients for a respective frame of the frame group. Even more particularly, the transform units may be configured to determine a frame-type dependent set of frequency coefficients for each of the possible frame-types of the frame. The audio encoder may then comprise a selection unit configured to select (for each one of the K frames) the appropriate set of frequency coefficients from the plurality of frame-type dependent sets of frequency coefficients, wherein the appropriate set of frequency coefficients corresponds to the frame-type of the respective frame.

Alternatively, the K parallel signal-attack detection units may be operated in sequence with the frame-type detection unit and in sequence with the K parallel transform units. As such, the K parallel signal-attack detection units may be implemented on the same respective processing units as the K parallel transform units. In this case, the K parallel transform units may know the frame-type of the respective frame, such that the K parallel transform units may be configured to transform the K frames into the respective frame-type dependent sets of frequency coefficients which correspond to the frame-type of the respective frame.

The audio encoder may comprise K parallel quantization and encoding units. The K parallel quantization and encoding units may be implemented on at least K different processing units (e.g. the respective processing units of the K parallel transform units). The quantization and encoding units may be configured to quantize and entropy encode (e.g. Huffman encode) the sets of frequency coefficients, respectively, under consideration of a respective number of allocated bits. In other words, the quantization and encoding of the K frames of the frame group may be performed independently by K parallel quantization and encoding units. For this purpose, the K parallel quantization and encoding units are provided with K indications of respective numbers of allocated bits. The indications of respective numbers of allocated bits may be determined jointly for the frame group in a joint bit allocation process, as will be outlined below.

The audio encoder may further comprise K parallel psychoacoustic units. The K parallel psychoacoustic units may be implemented on at least K different processing units. Typically, the K parallel psychoacoustic units may be implemented on the same respective processing units as the K parallel transform units, as the K parallel psychoacoustic units typically further process the respective K sets of frequency coefficients provided by the K parallel transform units. The K parallel psychoacoustic units may be configured to determine one or more frame dependent (and typically frequency dependent) masking thresholds based on the K sets of frequency coefficients, respectively. Alternatively or in addition, the K parallel psychoacoustic units may be configured to determined K perceptual entropy values for the corresponding K frames of the frame group. In general terms, a perceptual entropy value provides an indication of the informational content of a corresponding frame. Typically, the perceptual entropy value corresponds to an estimate of a number of bits which should be used to encode the corresponding frame. In particular, the perceptual entropy value for a given frame may indicate how many bits are needed to quantize and encode the given frame, under the assumption that the noise which is allocated to the quantized frame lies just at below the one or more masking thresholds.

The K parallel quantization and encoding units may be configured to quantize and entropy encode the K sets of frequency coefficients, respectively, under consideration of the respective one or more frame dependent masking thresholds. As such, it can be ensured that the quantization of the sets of frequency coefficients is performed under psychoacoustic considerations, thereby reducing the audible quantization noise.

The audio encoder may comprise a bit allocation unit configured to allocate the respective number of bits to the K parallel quantization and encoding units, respectively. For this purpose, the bit allocation unit may consider a total number of available bits for the frame group and distribute the total number of available bits to the respective frames of the frame group. The bit allocation unit may be configured to allocate the respective number of bits under consideration of the frame-type of the respective frame of the frame group. Furthermore, the bit allocation unit may take into account the frame-types of some of all of the frames of the frame group, in order to improve the allocation of bits to the frames of the frame group. Alternatively or in addition, the bit allocation unit may take into account the K perceptual entropy values for the K frames of the frame group determined by the K parallel psychoacoustic units, in order to allocate the respective number of bits to the K frames. In particular, the bit allocation unit may be configured to scale or modify the K perceptual entropy values in dependency of the total number of available bits for the frame group, thereby adapting the bit allocation to the perceptual entropy of the K frames of the frame group.

The audio encoder may further comprise a bit reservoir tracking unit configured to track a number of previously consumed bits used for encoding frames of the audio signal preceding the K frames. Typically, the audio encoder is provided with a target bit-rate for the encoded audio signal. As such, the bit reservoir tracking unit may be configured to track the number of previously consumed bits in relation to the number of targeted bits. Furthermore, the bit reservoir tracking unit may be configured to update the number of previously consumed bits with a number of bits used by the K parallel quantization and encoding units for encoding the K sets of frequency coefficients, thereby yielding a number of currently consumed bits. The number of currently consumed bits may then be the basis for the bit allocation process for the subsequent frame group of subsequent K frames.

The bit allocation unit may be configured to allocate the respective number of bits (i.e. the respective number of bits allocated for the encoding of the K frames of the frame group) under consideration of the number of previously consumed bits (provided by the bit reservoir tracking unit). Furthermore, the bit allocation unit may be configured to allocate the respective number of bits under consideration of the target bit-rate for encoding the audio signal.

As such, the bit allocation unit may be configured to allocate the respective bits to the frames of a frame group in a group-wise manner (in contrast to a frame-by-frame manner). In order to further improve the allocation of bits, the bit allocation unit may be configured to allocate the respective number of bits to the K quantization and encoding units in an analysis-by-synthesis manner by taking into account the number of currently consumed bits. In other words, for a frame group, several iterations of bit allocation and quantization & encoding may be performed, wherein at subsequent iterations, the bit allocation unit may take into account the number of currently consumed bits used by the K quantization and encoding units.

As such, the bit allocation unit may be configured to allocate the respective number of bits under consideration of the number of currently consumed bits, thereby yielding a respective updated number of allocated bits for the K parallel quantization and encoding units, respectively. The K parallel quantization and encoding units may be configured to quantize and entropy encode the respective K sets of frequency coefficients, under consideration of the respective updated number of allocated bits. This iterative bit allocation process may be repeated for a pre-determined number of iterations, in order to improve the bit allocation among the frames of the frame group.

The K parallel quantization and encoding units and the K parallel transform units may be configured to operate in a pipeline architecture. This means that the K parallel transform units may be configured to process a succeeding frame group comprising K succeeding frames, while the K parallel quantization and encoding units encode the sets of frequency coefficients of the current frame group. In other words, the K parallel quantization and encoding units may quantize and encode K preceding sets of frequency coefficients corresponding to K preceding frames of the group of K frames, while the K parallel transform units transform the frames of the group of K frames.

According to a further aspect, a frame-based audio encoder configured to encode K frames (i.e. a frame group) of an audio signal in parallel on at least K different processing units is described. Any of the features related to audio encoders described in the present document are applicable. The audio encoder may comprise at least one of: K parallel transform units, wherein the K parallel transform units are configured to transform the K frames into K sets of frequency coefficients, respectively; K parallel signal-attack detection units, wherein the signal-attack detection units are configured to classify the K frames, respectively, based on the presence or absence of an acoustic attack within the respective one of the K frames; and/or K parallel quantization and encoding units, wherein the K parallel quantization and encoding units are configured to quantize and entropy encode the K sets of frequency coefficients, respectively.

According to a further aspect, a frame-based audio encoder configured to encode K frames (i.e. a frame group) of an audio signal in parallel on at least K different processing units is described. Any of the features related to audio encoders described in the present document are applicable. The audio encoder comprises a transform unit configured to transform the K frames into K corresponding sets of frequency coefficients, respectively. Furthermore, the audio encoder comprises K parallel quantization and encoding units, wherein the K parallel quantization and encoding units are configured to quantize and entropy encode the K sets of frequency coefficients, respectively, under consideration of a respective number of allocated bits. In addition, the audio encoder comprises a bit allocation unit configured to allocate the respective number of bits to the K parallel quantization and encoding units, respectively, based on a previously consumed number of bits used for encoding frames of the audio signal preceding the K frames.

According to another aspect, a frame-based audio encoder configured to encode K frames of an audio signal in parallel on at least K different processing units is described. Any of the features related to audio encoders described in the present document are applicable. The audio encoder comprises K parallel signal-attack detection units, wherein the signal-attack detection units are configured to classify the K frames based on the presence or absence of an acoustic attack within the respective frame, respectively. Furthermore, the audio encoder comprises a frame-type detection unit configured to determine a frame-type of frame k, k=1, . . . , K, of the frame group based on the classification of the frame k and based on the frame-type of the previous frame k−1. In addition, the audio encoder comprises K parallel transform units, wherein the K parallel transform units are configured to transform the K frames into K sets of frequency coefficients, respectively. Typically, the set of frequency coefficients corresponding to a frame depends on the frame-type of that frame. In other words, the transform units are configured to perform a frame-type dependent transformation. According to a further aspect, a method for encoding an audio signal comprising a sequence of frames is described. The method may comprise any one or more of: transforming K frames of the audio signal into corresponding K sets of frequency coefficients in parallel; classifying in parallel each of the K frames based on the presence or absence of an acoustic attack within the respective one of the K frames; and quantizing and entropy encoding in parallel each one of the K sets of frequency coefficients, under consideration of a respective number of allocated bits.

According to another aspect, a method for encoding an audio signal comprising a sequence of frames is described. The method may comprise transforming K frames of the audio signal into K corresponding sets of frequency coefficients; quantizing and entropy encoding each of the K sets of frequency coefficients in parallel, under consideration of a respective number of allocated bits; and allocating the respective number of bits based on a previously consumed number of bits used for encoding frames of the audio signal preceding the K frames.

According to a further aspect, a method for encoding an audio signal comprising a sequence of frames is described. The method may comprise classifying each of K frames of the audio signal in parallel, based on the presence or absence of an acoustic attack within a respective one of the K frames; determining a frame-type of each frame k, k=1, . . . , K, of the K frames based on the classification of the frame k and based on the frame-type of the frame k−1; and transforming each of the K frames in parallel into a respective one of K sets of frequency coefficients; wherein the set k of frequency coefficients corresponding to frame k depends on the frame-type of frame k.

According to a further aspect, a software program is described. The software program may be adapted for execution on a processor and for performing the method steps outlined in the present document when carried out on a computing device.

According to another aspect, a storage medium is described. The storage medium may comprise a software program adapted for execution on a processor and for performing the method steps outlined in the present document when carried out on a computing device.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. Furthermore, all aspects of the methods and systems outlined in the present document may be arbitrarily combined. In particular, the features of the claims may be combined with one another in an arbitrary manner.

DESCRIPTION OF THE DRAWINGS

The invention is explained below in an exemplary manner with reference to the accompanying drawings, wherein.

DETAILED DESCRIPTION OF THE INVENTION

Figure 1A:
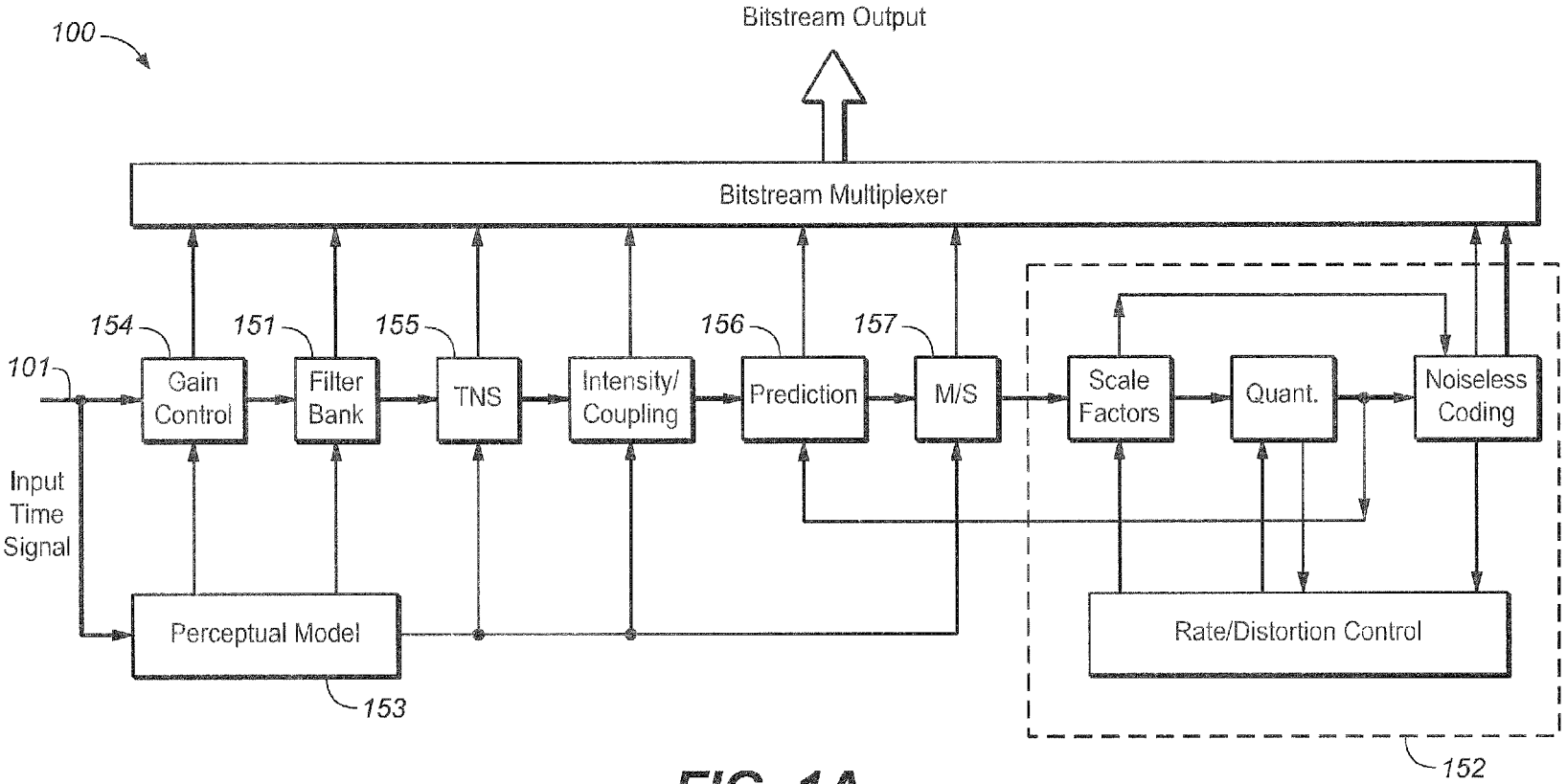
FIG. 1*a* illustrates a block diagram of an example audio encoder.

FIG. 1*a* illustrates an example audio encoder 100. In particular, FIG. 1*a* illustrates an example Advanced Audio Coding (AAC) encoder 100. The audio encoder 100 may be used as a core encoder in the context of a spectral band replication (SBR) based encoding scheme such as high efficiency (HE) AAC. Alternatively, the audio encoder 100 may be used standalone. The AAC encoder 100 typically breaks an audio signal 101 into a sequence of segments called frames. A time domain processing, called a window, provides smooth transitions from frame to frame by modifying the data in these frames. The AAC encoder 100 may adapt the encoding of a frame of the audio signal to the characteristics of the time domain signal comprised within the frame (e.g. a tonal section or a transient section of the audio signal). For this purpose, the AAC encoder 100 is adapted to dynamically switch between the encoding of the entire frame as a long-block of M=1028 samples and the encoding of the frame as a sequence of short-blocks of M=128 samples. As such, the AAC encoder 100 may switch between the encoding at relatively high frequency resolution (using a long-block) and the encoding at relatively high time resolution (using a sequence of short-blocks). As such, the AAC encoder 100 is adapted to encode audio signals that vacillate between tonal (steady-state, harmonically rich complex spectra signals) (using a long-block) and impulsive (transient signals) (using a sequence of eight short-blocks).

Figure 1B:
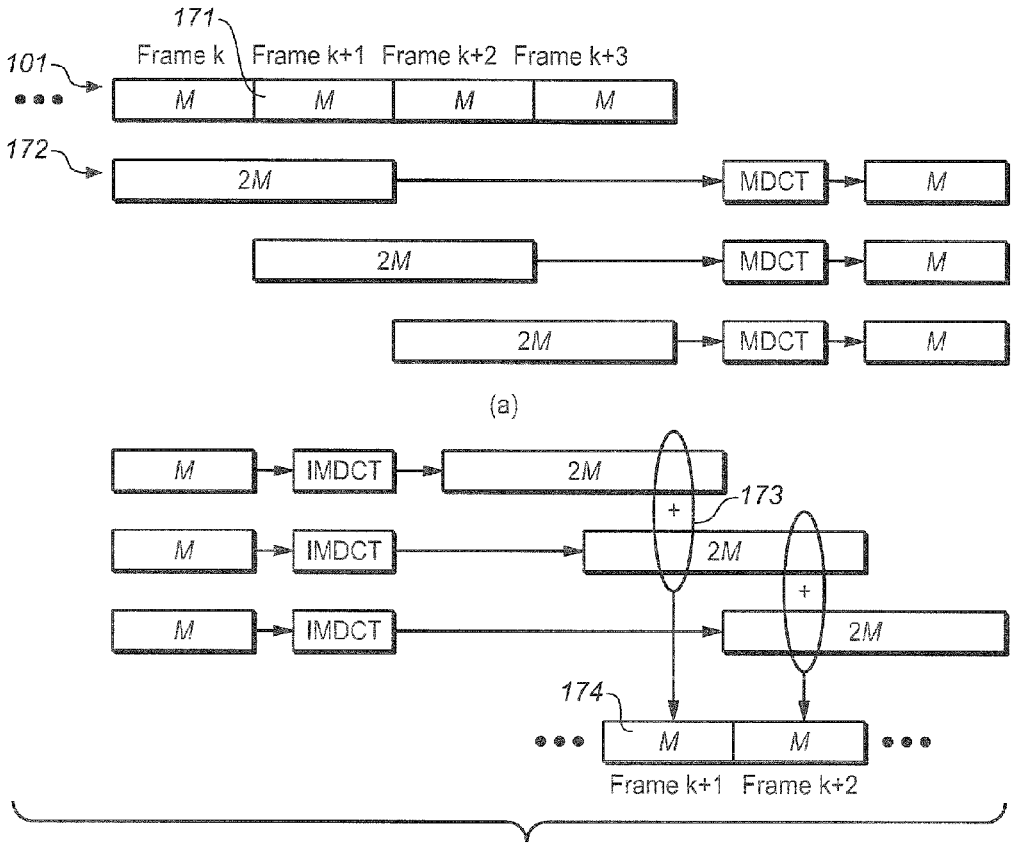
FIG. 1*b* illustrates an example frame based time-frequency transform applied by an audio encoder.

Each frame of samples is converted into the frequency domain using a Modified Discrete Cosine Transform (MDCT). In order to circumvent the problem of spectral leakage, which typically occurs in the context of block-based (also referred to as frame-based) time frequency transformations, MDCT makes use of overlapping windows, i.e. MDCT is an example of a so-called overlapped transform. This is illustrated in FIG. 1*b*, which shows an audio signal 101 comprising a sequence of frames 171. In the illustrated example, each frame 171 comprises M samples of the audio signal 101. Instead of applying the transform to only a single frame, the overlapping MDCT transforms two neighboring frames in an overlapping manner, as illustrated by the sequence 172. To further smoothen the transition between sequential frames, a window function w[k] of length 2M is additionally applied. As a result, a sequence of sets of frequency coefficients of size M is obtained. At the corresponding AAC decoder, the inverse MDCT is applied to the sequence of sets of frequency coefficients, thereby yielding a sequence of sets of time-domain samples with a length of 2M. Using an overlap and add operation 173 as illustrated in FIG. 1*b*, frames of decoded samples 174 of length M are obtained.

FIG. 1*a* illustrates further details of an example AAC encoder 100. The encoder 100 comprises a filter bank 151 which applies the MDCT transform to a frame of samples of the audio signal 101. As outlined above, the MDCT transform is an overlapped transform and typically processes the samples of two frames of the audio signal 101 to provide the set of frequency coefficients. The set of frequency coefficients is submitted to quantization and entropy encoding in unit 152. The quantization & encoding unit 152 ensures that an optimized tradeoff between target bit-rate and quantization noise is achieved. Additional components of an AAC encoder 100 are a perceptual model 153 which is used (among others) to determine signal dependent masking thresholds which are applied during quantization and encoding. Furthermore, the AAC encoder 100 may comprise a gain control unit 154 which applies a global adjustment gain to each frame of the audio signal 101. By doing this, the dynamic range of the AAC encoder 100 can be increased. In addition, temporal noise shaping (TNS) 155, backward prediction 156, and joint stereo coding 157 (e.g. mid/side signal encoding) may be applied.

In the present document, various measures for accelerating the audio encoding scheme illustrated in FIG. 1 are described. It should be noted that, even though these measures are described in the context of AAC encoding, the measures are applicable to audio encoders in general. In particular, the measures are applicable to block based (or frame based) audio encoders in general.

Figure 2:
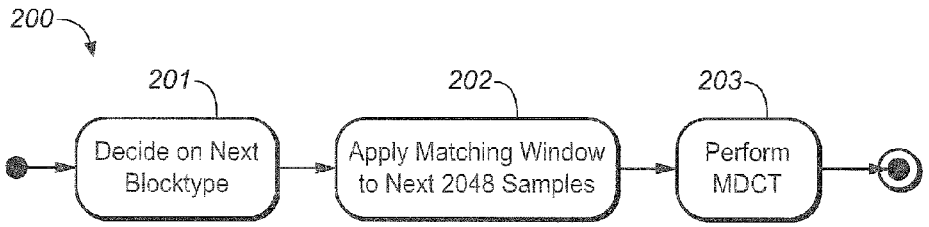
FIG. 2 shows a block diagram of an excerpt of an example audio encoder.

FIG. 2 shows an example block diagram of an excerpt 200 of the AAC encoder 100. The schema 200 relates to the filter bank block 151 shown in FIG. 1*a*. As outlined above, the AAC encoder 100 classifies the frames of the audio signal 101 as so-called long-blocks and short-blocks, in order to adapt the encoding to the particular characteristics of the audio signal 101 (tonal vs. transient). For this purpose, the AAC encoder 100 analyzes each frame (comprising M=1024 samples) of the audio signal 101 and makes a decision regarding the appropriate block-type for the frame. This is performed in block-type decision unit 201. It should be noted that in addition to a long-block and a sequence of (N=8) short-blocks, AAC provides the additional block-types of a "start block" (as a transit block between a long-block and a sequence of short-blocks) and of a "stop block" (as a transit block between a sequence of short-blocks and a long-block).

Subsequent to the decision on the block-type, an appropriate window is applied to the frame of the audio signal 101 (windowing unit 202). As outlined above, the MDCT transform is an overlapped transform, i.e. the window is applied to the current frame k of the audio signal 101 and to the previous frame k−1 (i.e. to a total of 2M=2048 samples). The windowing unit 202 typically applies a type of window which is adapted to the block-type determined in the block-type decision unit 201. This means that the shape of the window is dependent on the actual type of the frame k. Subsequently to applying a window to a group of adjacent frames, the appropriate MDCT transform is applied to the windowed group of adjacent frames, in order to yield the set of frequency coefficients corresponding to the frame of the audio signal 101. By way of example, if the block-type of the current frame k is "short-blocks", a sequence of eight short-blocks of windowed samples of the current frame k are converted into eight sets of frequency coefficients using eight consecutive MDCT transforms 203. On the other hand, if the block-type of the current frame k is "long-block", the windowed samples of the current frame k are converted into a single set of frequency coefficients using a single MDCT transform.

The above process is repeated for all of the frames of the audio signal 101, thereby yielding a sequence of sets of frequency coefficients which are quantized and encoded in a sequential manner. Due to the sequential encoding scheme, the overall encoding speed is limited by the processing power of the processing unit which is used to encode the audio signal 101.

Figure 3:
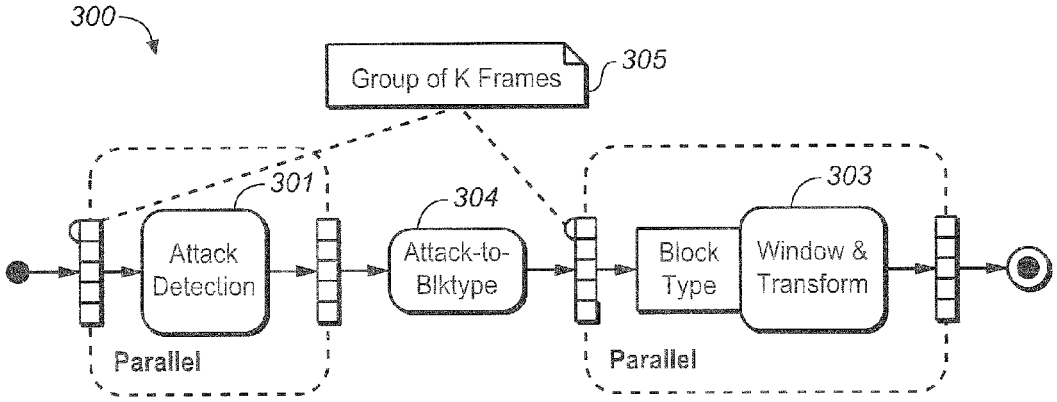
FIG. 3 shows a block diagram of an example parallel architecture for the encoder excerpt shown in FIG. 2.

It is proposed in the present document to break up the dependency chain of a conventional audio encoder 100, 200 described in the context of FIGS. 1*a* and 2, in order to accelerate the overall encoding speed. In particular, it is proposed to parallelize at least the transform related encoding tasks described in the context of FIG. 2. An example of a parallelized architecture 300 corresponding to the sequential architecture 200 is illustrated in FIG. 3. In the parallelized architecture 300 a plurality of frames 305 of the audio signal 101 are collected. By way of example, K=10 frames of the audio signal 101 are collected. For each of the plurality of K frames 305 a signal-attack detection is performed (by signal-attack detection unit 301), in order to determine if a frame k, k=1, . . . , K, comprises tonal or transient content. Based on this classification of each of the plurality of K frames 305, the attack-to-block-type unit 304 may determine the respective block-type for each of the plurality of K frames 305. In particular, the attack-to-block-type unit 304 may determine if a particular frame k from the plurality of K frames 305 should be encoded as a sequence of short-blocks, as a long-block, as a start-block or as a stop-block.

Having determined the respective block-type, the window-and-transform unit 303 may apply the appropriate window and the appropriate MDCT transform to each of the plurality of K frames 305. This may be done in parallel for the K frames 305. In view of the overlap between adjacent frames, the K parallel windowing and transform processes may be fed with groups of adjacent frames. By way of example, the K parallel windowing and transform processes may be indentified by the index k=1, . . . , K. A kth process handles the kth frame of the plurality of K frames. As the windowing and the transform typically overlap, the kth process may in addition be provided with one or more preceding frames of the kth frame (e.g. with the (k−1)th frame). As such, the K processes may be performed in parallel, thereby providing K sets of frequency coefficients for the K frames 305 of the audio signal 101.

In contrast to the sequential architecture 200 illustrated in FIG. 2, the parallel architecture 300 may be executed on K parallel processing units, thereby accelerating the overall processing speed by a factor of K compared to the sequential processing described in FIG. 2.

Alternatively or in addition, the architecture 200 of FIG. 2 can be parallelized by breaking up the dependency chain between the block-type decision and the windowing/transforming of the frames of the audio signal 101. The dependency chain may be broken up by tentatively performing computation that may be discarded later. The benefit of such a speculative execution of computation is that as a result of the speculative execution a large number of uniform processing tasks are executed which can be parallelized. The inefficiency created by discarding part of the computational results is typically outweighed by the increased speed provided by parallel execution.

As outlined in the context of FIGS. 2 and 3, an AAC encoder 100 first decides on a block-type, and only then performs the windowing and transform processing. This leads to a dependency, where the windowing and transformation can only be performed once the block-type decision is performed. However, when allowing speculative execution as illustrated by the encoding scheme 400 in FIG. 4, four different transforms, using the four different window-types available in AAC, can be performed in parallel on each (overlapped) frame 1 of the audio signal 101. The four sets of frequency coefficients for each frame 1 are determined in parallel in the window and transform unit 403. As a result, four sets of frequency coefficients are obtained for each frame 1 of the audio signal 101 (a set for a long-block type, a set for a short-block type, a set for a start-block type and a set for a stop-block type). The block-type decision 301 may be performed independently (e.g. in parallel) to the windowing and transformation of the frame k. Depending on the block-type of frame 1 determined in the parallel block-type decision 301, an appropriate set of frequency coefficients may be selected for the frame 1 using a selection unit 406. The other three sets of frequency coefficients which are provided by the window and transform unit 403 may be discarded.

As a result of such speculative execution, L frames of the audio signal may be submitted to windowing and transformation processing 403 in parallel using different processing units. Each of the processing units (e.g. the lth processing unit, l=1, . . . , L) determines four sets of frequency coefficients for the lth frame handled by the processing unit, i.e. each processing unit performs about four times more processing steps compared to the windowing and transformation 301 performed when the block-type is already known. Nevertheless, the overall encoding speed can be increased by a factor of L/4 by the parallelized architecture 400 shown in FIG. 4. L may be selected in the range of several hundred. This makes the suggested methods suitable for application in processor farms with a large number of parallel processors.

The parallel architecture 400 may be used alternatively or in combination with the parallel architecture 300. It should be noted, however, that as a result of parallelization, the encoding latency will typically increase. On the other hand, the encoding speed may be significantly increased, thereby making the parallelized architectures interesting in the context of audio download applications, where fast ("on the fly") downloads can be achieved by massive parallelization of the encoding process.

Figure 5:
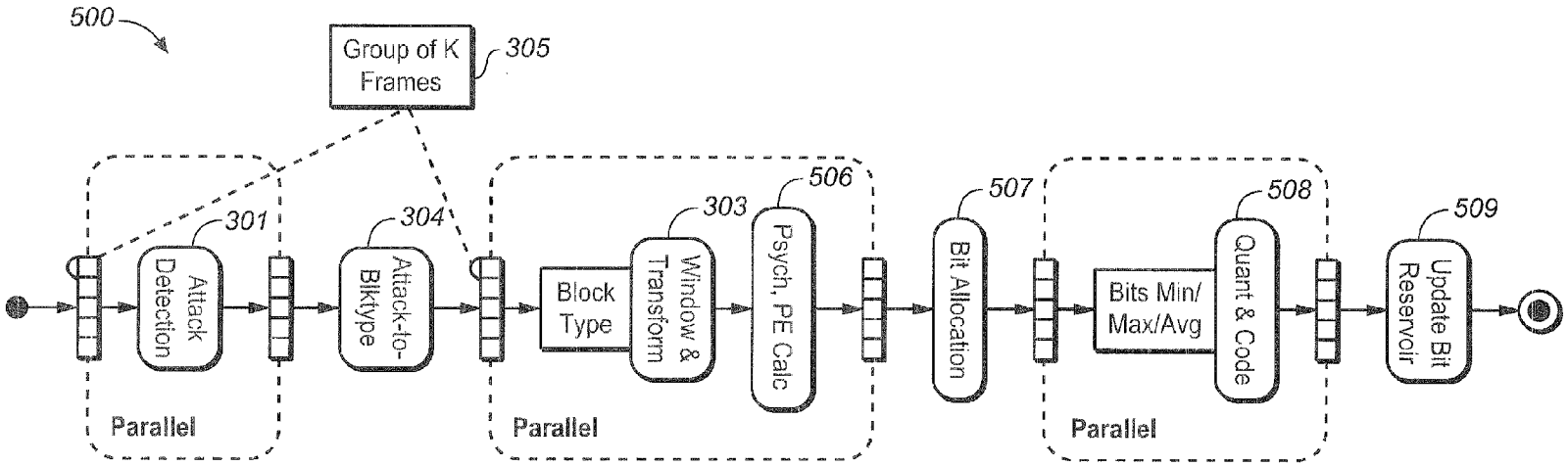
FIG. 5 illustrates a block diagram of an example audio encoder comprising various parallelized encoder processes.

FIG. 5 illustrates a further example parallel encoder architecture 500. The architecture 500 is an extension of the architecture 300 and includes the additional aspects of applying the psychoacoustic model 153 and of performing quantization and encoding 152. In a similar manner to FIG. 3, the architecture 500 comprises a signal-attack detection unit 301 which processes K frames 305 of the audio signal 101 in parallel. Based on the classified frames, the attack-to-block-type unit 304 determines the block-type of each of the K frames 305. Subsequently, K sets of frequency coefficients corresponding to the K frames 305 are determined in K parallel processes within the windowing and transform unit 303. These K sets of frequency coefficients may be used in the psychoacoustic processing unit 506 to determine frequency dependent masking thresholds for the K sets of frequency coefficients. The masking thresholds are used within the quantization and encoding unit 508 for quantizing and encoding the K sets of frequency coefficients in a frequency dependent manner under psychoacoustic considerations. In other words, for the kth set of frequency coefficients (i.e. for the kth frame), the psychoacoustic processing unit 506 determines one or more frequency dependent masking thresholds. The determination of the one or more masking thresholds may be performed in parallel for the k=1, . . . , K sets of frequency coefficients. The one or more masking thresholds of the kth frame is provided to the (serial or parallelized) quantization and coding unit 152, 508 for quantization and encoding of the kth set of frequency coefficients. As such, the determination of the frequency dependent masking thresholds may be parallelized, i.e. the determination of the masking thresholds may be performed on K independent processing units in parallel, thereby accelerating the overall encoding speed.

Furthermore, FIG. 5 illustrates an example parallelization of the quantization and encoding process 152. Quantization is typically done via a power-law quantization. By doing this, larger frequency coefficient values are automatically coded with less accuracy and some noise shaping is already built into the quantization process. The quantized values are then encoded by Huffman coding. In order to adapt the coding process to different local statistics of the audio signal 101, a particular (optimum) Huffman table may be selected from a number of Huffman tables stored in a database. Different Huffman tables may be selected for different parts of the spectrum of the audio signal. By way of example, the Huffman table used for encoding the kth set of frequency coefficients may dependent on the block-type of the kth frame.

It should be noted that the search for a particular (optimum) Huffman table may be further parallelized. It is assumed that P is the total number of possible Huffman tables. For the kth frame (k=1, . . . , K), the kth set of frequency coefficients may be encoded using a different one of the P Huffman tables in P parallel processes (running on P parallel processing units). This leads to P encoded sets of frequency coefficients, wherein each of the P encoded sets of frequency coefficients has a corresponding bit-length. The Huffman table which leads to the encoded set of frequency coefficient with the lowest bit-length may be selected as the particular (optimum) Huffman table for the kth frame. Alternatively to a full parallelization scheme, intermediate parallelization schemes such as a divide-and-conquer strategy with alpha/beta pruning of branches (wherein each branch is executed in a separate parallel processing unit) may be used to determine the particular (optimum) Huffman table for the kth frame.

Since Huffman coding is a variable code length method and since noise shaping should be performed to keep the quantization noise below the frequency dependent masking threshold, a global gain value (determining the quantization step size) and scalefactors (determining noise shaping factors for each scalefactor (i.e. frequency) band) are typically applied prior to the actual quantization. The process for determining an optimum tradeoff between the global gain value and the scalefactors for a given frame of the audio signal 101 (under the constraint of a target bit-rate and/or target perceptual distortion) is usually performed by two nested iteration loops in an analysis-by-synthesis manner. In other words, the quantization and encoding process 152 typically comprises two nested iterations loops, a so-called inner iteration loop (or rate loop) and an outer iteration loop (or noise control loop).

In the context of the inner iteration loop (rate loop), a global gain value is determined such that the quantized and encoded set of frequency coefficients meets the target bit-rate (or meets the allocated number of bits for the particular frame k). In general, the Huffman code tables assign shorter code words to (more frequent) smaller quantized values. If the number of bits resulting from the coding operation exceeds the number of bits available to code a given frame k, this can be corrected by adjusting the global gain to result in a larger quantization step size, thus leading to smaller quantized values. This operation is repeated with different quantization step sizes until the number of bits required for the Huffman coding is smaller or equal to the bits allocated to the frame. This loop is called rate loop because the loop modifies the overall encoder bit-rate until the bit-rate meets a target bit-rate. In the context of the outer iteration loop (noise control loop), the frequency dependent scalefactors are adapted to the frequency dependent masking thresholds to control the overall perceptual distortion. In order to shape the quantization noise according to the frequency dependent masking thresholds, scalefactors are applied to each scalefactor band. The scalefactor bands correspond to frequency intervals within the audio signal and each scalefactor band comprises a different subset of a set of frequency coefficients. Typically, the scalefactor bands correspond to a perceptually motivated fragmentation of the overall frequency range of the audio signal into critical subbands. The encoder typically starts with a default scalefactor of 1 for each scalefactor band. If the quantization noise in a given band is found to exceed the frequency dependent masking threshold (i.e. the allowed noise in this band), the scalefactor for this band is adjusted to reduce the quantization noise. As such, the scalefactor corresponds to a frequency dependent gain value (in contrast to the overall gain value adjusted in the rate adjustment loop), which may be used to control the quantization step in each scalefactor band individually.

Since achieving a smaller quantization noise requires a larger number of quantization steps and thus a higher bit-rate, the rate adjustment loop may need to be repeated every time new scalefactors are used. In other words, the rate loop is nested within the noise control loop. The outer (noise control) loop is executed until the actual noise (computed from the difference of the original spectral values minus the quantized spectral values) is below the masking threshold for every scalefactor band (i.e. critical band).

While the inner iteration loop always converges, this is not true for the combination of both iteration loops. By way of example, if the perceptual model requires quantization step sizes so small that the rate loop always has to increase the quantization step sizes to enable coding at the target bit-rate, both loops will not converge. Conditions may be set to stop the iterations if no convergence is achieved. Alternatively or in addition, the determination of the masking thresholds may be based on the target bit-rate. In other words, the masking thresholds determined e.g. in the perceptual processing unit 506 may be dependent on the target bit-rate. This typically enables a convergence of the quantization and encoding scheme to the target bit-rate.

It should be noted that the above mentioned iterative quantization and encoding process (also referred to as noise allocation process) is only one possible process for determining a set of quantized and encoded frequency coefficients. The parallelization schemes described in the present document equally apply to other implementations of the parallel noise allocation processes within the quantization and encoding unit 508.

As a result of the quantization and encoding process, a set of quantized and encoded frequency coefficients is obtained for a corresponding frame of the audio signal 101. This set of quantized and encoded frequency coefficients is represented as a certain number of bits which typically depends on the number of bits allocated to the frame. The acoustic content of an audio signal 101 may vary significantly from one frame to the next, e.g. a frame comprising tonal content versus a frame comprising transient content. Accordingly, the number of bits required to encode the frames (given a certain allowed perceptual distortion) may vary from frame to frame. By way of example, a frame comprising tonal content may require a reduced number of bits compared to a frame comprising transient content. At the same time, the overall encoded audio signal should meet a certain target bit-rate, i.e. the average number of bits per frame should meet a pre-determined target value.

In order to ensure a pre-determined target bit-rate and in order to take into account the varying bit requirements of the frames, the AAC encoder 100 typically makes use of a bit allocation process which works in conjunction with an overall bit reservoir. The overall bit reservoir is filled with a number of bits on a frame-by-frame basis in accordance to the target bit-rate. At the same time, the overall bit reservoir is updated with the number of bits which were used to encode a past frame. As such, the overall bit reservoir tracks the amount of bits which have already been used to encode the audio signal 101 and thereby provides an indication of the number of bits which are available for encoding a current frame of the audio signal 101. This information is used by the bit allocation process to allocate a number of bits for encoding of the current frame. For this allocation process, the block-type of the current frame may be taken into account. As a result, the bit allocation process may provide the quantization and encoding unit 152 with an indication of the number of bits which are available for the encoding of the current frame. This indication may comprise a minimum number of allocated bits, a maximum number of allocated bits and/or an average number of allocated bits.

The quantization and encoding unit 152 uses the indication of the number of allocated bits to quantize and encode the set of frequency coefficients corresponding to the current frame and thereby determines a set of quantized and encoded frequency coefficients which takes up an actual number of bits. This actual number of bits is typically only known after execution of the above explained quantization and encoding (including the nested loops), and may vary within the bounds provided by the indication of the number of allocated bits. The overall bit reservoir is updated using the actual number of bits and the bit allocation process is repeated for the succeeding frame.

FIG. 5 illustrates a parallelized quantization and encoding scheme 508 which performs the quantization and encoding of K sets of frequency coefficients corresponding to K frames 305 in parallel. As outlined above, the actual quantization and encoding of the kth set of frequency coefficients is independent of the quantization and encoding of the other sets of frequency coefficients. Consequently, the quantization and encoding of the K sets of frequency coefficients can be performed in parallel. However, the indication of the allocated bits (e.g. maximum, minimum and/or average number of allocated bits) for the quantization and encoding of the kth set of frequency is typically dependent on the status of the overall bit reservoir subsequent to the quantization and encoding of the (k−1)th set of frequency coefficients. Therefore, a modified bit allocation process 507 and a modified bit reservoir update process 509 is described in the present document, which enable the implementation of a parallelized quantization and encoding process 508.

An example bit allocation process 507 may comprise the step of updating the bit reservoir subsequent to the actual quantization and encoding 508 of K sets of frequency coefficients. The updated bit reservoir may then be the basis for a bit allocation process 507 which provides the allocation of bits to the subsequent K sets of frequency coefficients in parallel. In other words, the bit reservoir update process 509 and the bit allocation process 507 may be performed per groups of K frames (instead of performing the process on a per frame basis). More particularly, the bit allocation process 507 may comprise the step of obtaining a total number T of available bits for a group of K frames (instead of obtaining the number of available bits on a frame-by-frame basis) from the bit reservoir. Subsequently, the bit allocation process 507 may distribute the total number T of available bits to the individual frames of the group of K frames, thereby yielding a respective number Tk, k=1, . . . , K, of allocated bits for the respective kth frame of the group of K frames. The bit allocation process 507 may take into account the block-type of the frames of the K frames. In particular, the bit allocation process 507 may take into account the block-type of all the frames of the K frames in conjunction, in contrast to a sequential bit allocation process 507, where only the block-type of each individual frame is taken into account. This additional information regarding the block-type of adjacent frames within a group of K frames may be taken into account to provide an improved allocation of bits.

Figure 7:
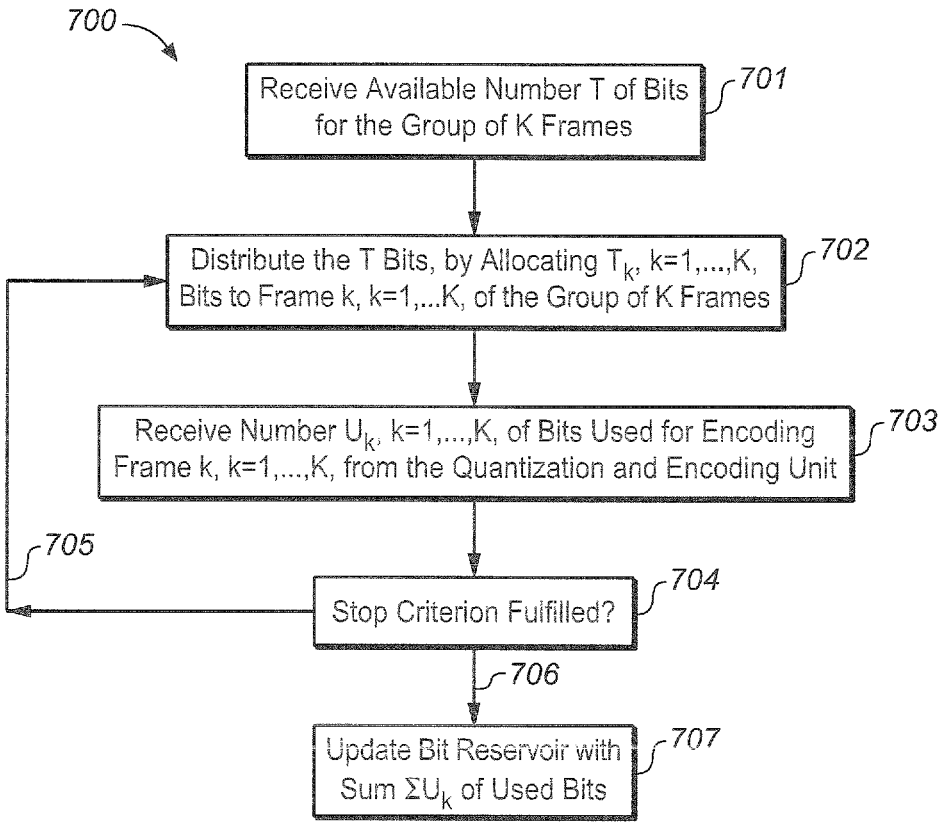
FIG. 7 shows an example flow chart of an iterative bit allocation process.

In order to further improve the allocation of bits to the frames of the group of K frames, the bit allocation/bit reservoir update process may be performed in an analysis-by-synthesis manner, thereby optimizing the overall bit allocation. An example iterative bit allocation process 700 making use of an analysis-by-synthesis scheme is illustrated in FIG. 7. In step 701, a total number T of bits for encoding the group of K frames 305 is received from the bit reservoir. This total number T of bits is subsequently distributed to the frames of the group of K frames, thereby yielding a number Tk of allocated bits for each of the frames k, k=1, . . . , K, of the group of K frames (step 702). In the first iteration of the bit allocation process 700, the distribution step 702 may be based mainly on the block-types of the K frames within group 305. The numbers Tk are passed to the respective quantization and encoding units 508, where the K frames are quantized and encoded, thereby yielding K encoded frames. The K encoded frames use up Uk, k=1, . . . , K, bits, respectively. The number Uk of used up bits is received in step 703.

Subsequently, it is verified if a stop criterion for the iterative bit allocation process 700 is fulfilled (step 704). Example stop criterion may comprise AND or OR combinations of the following one or more criteria: the iterative bit allocation process has performed a pre-determined maximum number of iterations; the sum of the used-up bits, i.e. ΣUk, meets a pre-determined relation to the available number T of bits; the numbers Uk and Tk meet a pre-determined relationship for some or all of k=1, . . . , K, etc. By way of example, if U1<T1 for a frame 1, it may be beneficial to perform another iteration of the bit allocation process 700, wherein T1 is reduced by the difference of T1 and U1 and the available bits (T1-U1) are allocated to another frame.

If the stop criterion is not met (reference numeral 705), a further iteration of the bit allocation process 700 is performed, wherein the distribution of the T bits (step 702) is performed under consideration of the used up bits Uk, k=1, . . . , K, of the previous iteration. On the other hand, if the stop criterion is met (reference numeral 706), then the iterative process it terminated and the bit reservoir is updated with the actually used up number Uk of bits (i.e. the used up bits of the last iteration).

In other words, for a group of K frames, preliminary bits may first be allocated to each of the K parallel quantization and encoding processes 508. As a result, K sets of quantized and encoded frequency coefficients and K actual numbers of used bits are determined The distribution of the K actual numbers of bits may then be analyzed and the bit allocations to the K parallel quantization and encoding processes 508 may be modified. By way of example, allocated bits which were not used by a particular frame may be assigned to another frame (e.g. a frame which has used up all of the allocated bits). The K parallel quantization and encoding processes 508 may be repeated using the modified bit allocation process, and so on. Several iterations (e.g. two or three iterations) of this process may be performed, in order to optimize the group-wise bit allocation process 507.

Figure 4:
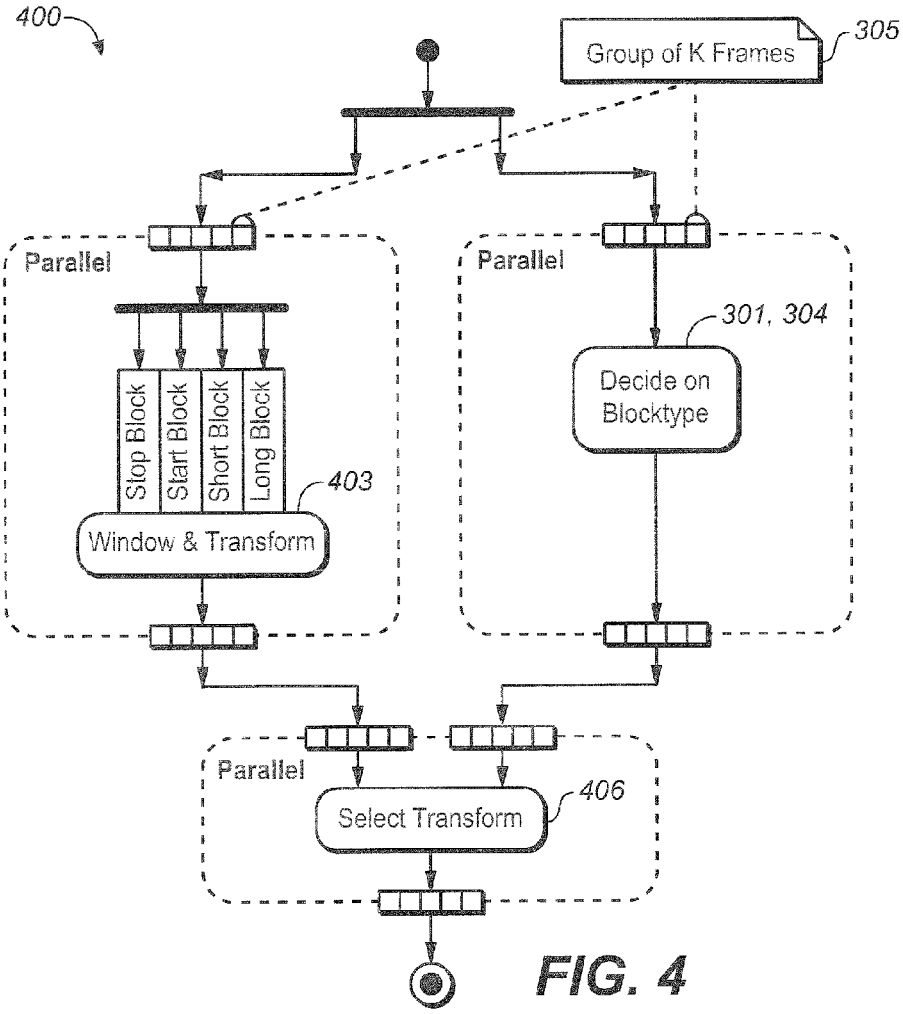
FIG. 4 shows a block diagram of another example parallel architecture for the encoder excerpt shown in FIG. 2.
Figure 6:
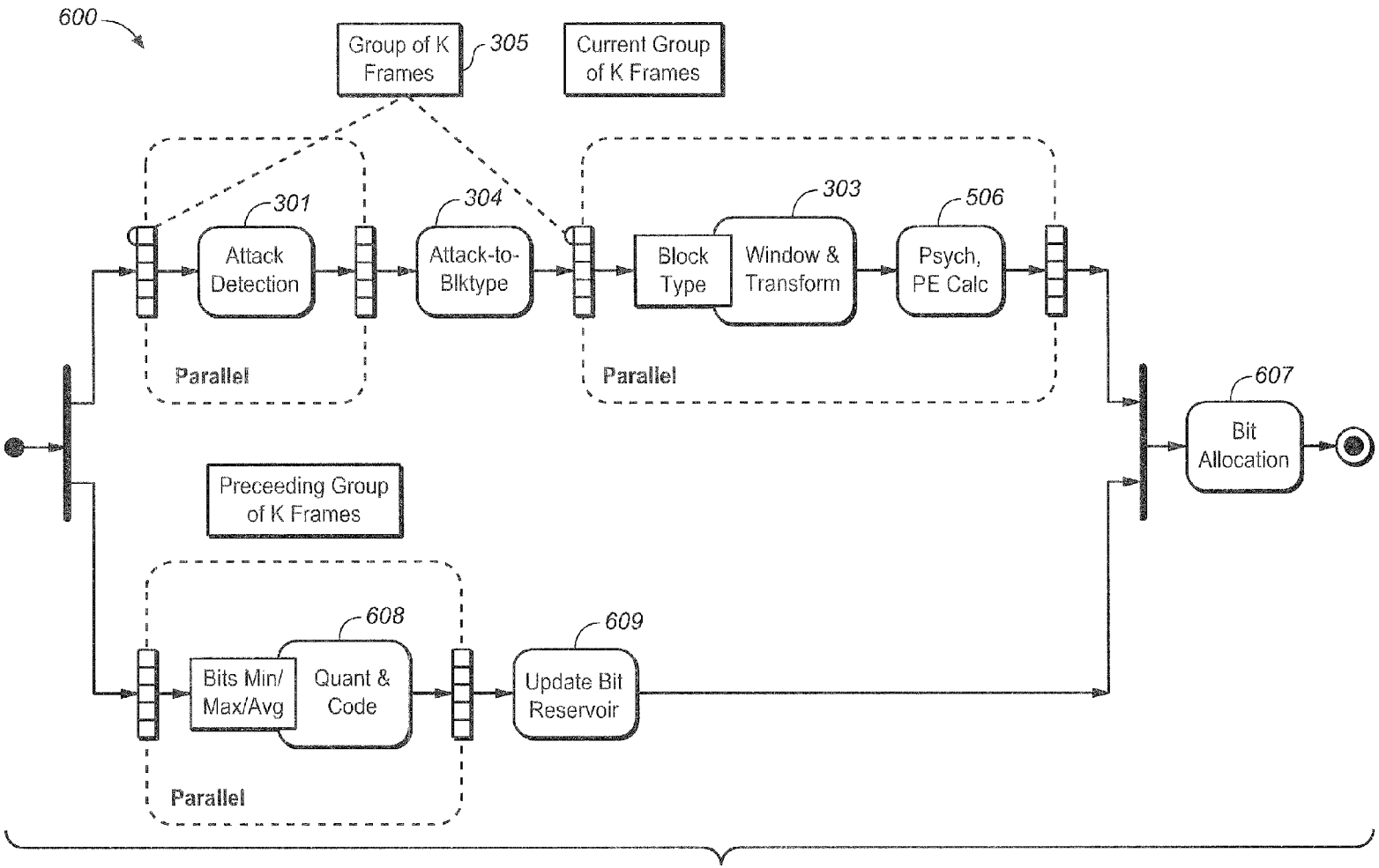
FIG. 6 illustrates a block diagram of an example pipelining architecture of an audio encoder.

FIG. 6 illustrates a pipeline scheme 600 which can be used alternatively or in addition to the parallelization schemes outlined in FIGS. 3, 4 and 5. In the pipeline scheme 600, the set of frequency coefficients of a current frame k (reference numerals 301, 304, 303, 506) is determined in parallel to the quantization and encoding of the set of frequency coefficients of a preceding frame (k−1) (reference numerals 608, 609). The parallel processes are joined at the bit allocation stage 607 for the current frame k. As outlined above, the bit allocation stage 607 uses as input the bit reservoir which was updated with the actual number of bits used for encoding the set of frequency coefficients of the previous frame (k−1) and/or the block-type of the current frame k. When using the pipeline scheme 600 of FIG. 6, different processing units may be used for the determination of the set of frequency coefficients of a current frame k (reference numerals 301, 304, 303, 506) and for the quantization and encoding of the set of frequency coefficients of a preceding frame (k−1) (reference numerals 608, 609). This results in an acceleration of the encoding scheme by a factor of two.

As illustrated in FIG. 6, the pipeline scheme 600 may be used in combination with the parallelization schemes 300, 400, 500. This means that while a current group of K frames is transformed to provide K sets of frequency coefficients (reference numerals 301, 304, 303, 506), the previous K sets of frequency coefficients of the previous group of K frames may be quantized (reference numerals 608, 609). As outlined above, the parallelization of the determination of K sets of frequency coefficients for K frames allows for the implementation of these parallel processes on K different processing units. In a similar manner, the K parallel quantization and encoding processes 608 may be implemented on K different processing units. Overall, 2K parallel processing units may be used in the pipeline scheme 600 to yield an overall acceleration of the encoding scheme by a factor of 2K (e.g. by a factor of 20, in the case of K=10).

In the FIGS. 3, 4, 5 and 6 several architectures have been illustrated which may be used to provide an implementation of a fast audio encoder. Alternatively or in addition, measures can be taken for accelerating the actual implementation of the encoder on the one or more processing units. In particular, predicate logic may be used to yield an accelerated implementation of the audio encoder. Processing units with long processing pipelines typically suffer from conditional jumps, as such conditional jumps hinder (delay) the execution of the pipeline. The conditional execution of the pipeline is a feature on some processing units which may be used to provide an accelerated implementation. Alternatively, the conditional execution may be emulated using bit masks (instead of explicit conditions).

In the present document, various methods and systems for fast audio encoding are described. Several parallel encoder architectures are presented which enable the implementation of various components of an audio encoder on parallel processing units, thereby reducing the overall encoding time. The methods and systems for fast audio encoding may be used for faster-than-realtime audio encoding e.g. in the context of audio download applications.

It should be noted that the description and drawings merely illustrate the principles of the proposed methods and systems. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and systems and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

The invention claimed is:

1. A frame-based audio encoder comprising

K different hardware processing units that implement K parallel transform units and K parallel quantization and encoding units; and a hardware microprocessor that implements a bit allocation unit and a bit reservoir and tracking unit, wherein each of the K parallel transform units is configured to transform, in parallel, a respective one of a current group of K successive frames of an audio signal into a respective one of K current sets of frequency coefficients; wherein K>1; wherein each of the K successive frames of the audio signal comprises a plurality of samples of the audio signal;

wherein each of the K parallel quantization and encoding units is configured to quantize and entropy encode, in parallel, the respective one of the K current sets of frequency coefficients, under consideration of a respective number of allocated bits;

wherein the bit allocation unit is configured to allocate the respective number of bits to each of the K parallel quantization and encoding units under consideration of a number of previously consumed bits;

wherein the bit reservoir tracking unit is configured to update the number of previously consumed bits with a number of bits used by the K parallel quantization and encoding units for encoding the K sets of frequency coefficients of the audio signal for a group of K successive frames preceding the current group of K successive frames;

wherein each of the K parallel transform units is configured to transform the respective one of the K frames into a frame-type dependent set of frequency coefficients; and further comprising:

K parallel signal-attack detection units, wherein each signal-attack detection unit is configured to classify the respective one of the K frames based on the presence or absence of an acoustic attack within the respective one of the K frames, and a frame-type detection unit configured to determine the frame-type of each of the K frames based on the classification of the K frames; and wherein the frame-type is one of a short-block type, a long-block type, a start-block type and a stop-type, wherein the short-block type indicates a block having a first number of samples, wherein the long-block type indicates a block having a second number of samples that is a multiple of the first number of samples, wherein the start-block type indicates a first transition block between the long-block type and the short-block type, and wherein the stop-type indicates a second transition block between the short-block type and the long-block type.

2. The audio encoder of claim 1, wherein the frame-type detection unit is configured to determine a frame-type of each frame k, k=1, . . . , K, of the K frames also based on the frame-type of the frame k−1.

3. The audio encoder of claim 1, wherein each of the K parallel transform units is configured to transform the respective one of the K frames into a plurality of frame-type dependent sets of frequency coefficients; and the encoder further comprises a selection unit configured to select for each one of the K frames the set of frequency coefficients from the plurality of frame-type dependent sets of frequency coefficients, wherein the selected set corresponds to the frame-type of the respective frame.

4. The audio encoder of claim 1, wherein the K parallel signal-attack detection units are operated in sequence with the frame-type detection unit which is operated in sequence with the K parallel transform units.

5. The audio encoder of claim 1, wherein each of the K parallel transform units is configured to transform the respective one of the K frames into the set of frequency coefficients which corresponds to the frame-type of the respective frame determined by the frame-type detection unit.

6. The audio encoder of claim 1, further comprising

K parallel psychoacoustic units; wherein each of the K parallel psychoacoustic units is configured to determine one or more frame dependent masking thresholds based on the respective one of the K sets of frequency coefficients.

7. The audio encoder of claim 6, wherein each of the K parallel psychoacoustic units is configured to determine a perceptual entropy value indicative of an informational content of the respective one of the K frames.

8. The audio encoder of claim 7, wherein the bit allocation unit is configured to allocate the respective number of bits under consideration of the perceptual entropy values of the K frames.

9. The audio encoder of claim 6, wherein each of the K parallel quantization and encoding units is configured to quantize and entropy encode the respective one of the K sets of frequency coefficients, under consideration of the respective one or more frame dependent masking thresholds.

10. The audio encoder of claim 1, wherein the bit allocation unit is configured to allocate the respective number of bits under consideration of the frame-types of the K frames.

11. The audio encoder of claim 1, wherein the bit allocation unit is configured to allocate the respective number of bits under consideration of a target bit-rate for encoding the audio signal.

12. The audio encoder of claim 1, wherein the bit allocation unit is configured to allocate the respective number of bits in an analysis-by-synthesis manner taking into account the number of currently consumed bits.

13. The audio encoder of claim 1, wherein the bit allocation unit is configured to allocate the respective number of bits also under consideration of the number of currently consumed bits, thereby yielding a respective updated number of allocated bits for each of the K parallel quantization and encoding units; and each of the K parallel quantization and encoding units is configured to quantize and entropy encode the respective one of the K sets of frequency coefficients, under consideration of the respective updated number of allocated bits.

14. The audio encoder of claim 1, wherein the K parallel quantization and encoding units and the K parallel transform units are configured to operate in a pipeline architecture;

the K parallel quantization and encoding units quantize and encode K preceding sets of frequency coefficients corresponding to K preceding frames of the current group of K frames, while the K parallel transform units transform the frames of the current group of K frames.

15. The audio encoder of claim 1, wherein the first number of samples is 128 samples, wherein the second number of samples is 1024 samples, and wherein the multiple is 8.

16. The audio encoder of claim 1, wherein the audio encoder is adapted to dynamically switch between encoding at a high frequency resolution using the long-block type and encoding at a high time resolution using a sequence of the short-block type.

17. A frame-based audio encoder configured to encode K successive current frames of an audio signal in parallel using at least K different processing units; wherein K>1; the audio encoder comprising K different hardware processing units that implement K parallel quantization and encoding units; and a hardware microprocessor that implements a transform unit, a bit allocation unit and a bit reservoir and tracking unit, wherein the transform unit is configured to transform the K successive current frames of the audio signal into K corresponding current sets of frequency coefficients;

wherein each of the K parallel quantization and encoding units is configured to quantize and entropy encode, in parallel, a respective one of the K current sets of frequency coefficients, under consideration of a respective number of allocated bits;

wherein the bit allocation unit is configured to allocate the respective number of bits to each of the K parallel quantization and encoding units based on a previously consumed number of bits;

wherein the bit reservoir tracking unit is configured to update the number of previously consumed bits with a number of bits used by the K parallel quantization and encoding units for encoding the K sets of frequency coefficients of the audio signal for a group of K successive frames preceding the current group of K successive frames;

wherein the transform unit is configured to transform each of the K successive current frames into a frame-type dependent set of frequency coefficients; and further comprising:

a signal-attack detection unit that is configured to classify each of the K successive current frames based on the presence or absence of an acoustic attack within each of the K successive current frames, and a frame-type detection unit configured to determine the frame-type of each of the K successive current frames based on the classification of the K successive current frames; and wherein the frame-type is one of a short-block type, a long-block type, a start-block type and a stop-type, wherein the short-block type indicates a block having a first number of samples, wherein the long-block type indicates a block having a second number of samples that is a multiple of the first number of samples, wherein the start-block type indicates a first transition block between the long-block type and the short-block type, and wherein the stop-type indicates a second transition block between the short-block type and the long-block type.

18. A frame-based audio encoder configured to encode K successive frames of an audio signal in parallel; wherein K>1; the audio encoder comprising K different hardware processing units that implement K parallel signal-attack detection units and K parallel transform units; and a hardware microprocessor that implements a frame-type detection unit, wherein each of the K parallel signal-attack detection units is configured to classify, in parallel, a respective one of the K successive frames based on the presence or absence of an acoustic attack within the respective one of the K successive frames;

wherein the frame-type detection unit is configured to determine a frame-type of each frame k, k=1, . . . , K, of the K frames based on the classification of the frame k and based on the frame-type of the frame k−1;

wherein each of the K parallel transform units is configured to transform, in parallel, a respective one of the K successive frames into a respective one of K sets of frequency coefficients; wherein the set k of frequency coefficients corresponding to frame k depends on the frame-type of frame k; and wherein the frame-type is one of a short-block type, a long-block type, a start-block type and a stop-type, wherein the short-block type indicates a block having a first number of samples, wherein the long-block type indicates a block having a second number of samples that is a multiple of the first number of samples, wherein the start-block type indicates a first transition block between the long-block type and the short-block type, and wherein the stop-type indicates a second transition block between the short-block type and the long-block type.

19. A method for encoding an audio signal comprising a sequence of frames, the method comprising transforming, using K different hardware processing units respectively in parallel, K successive current frames of the audio signal into K corresponding current sets of frequency coefficients, wherein K>1;

quantizing and entropy encoding, using the K different hardware processing units respectively in parallel, each of the K successive current sets of frequency coefficients under consideration of a respective number of allocated bits; and allocating, using a hardware microprocessor, the respective number of bits based on a previously consumed number of bits; wherein the number of previously consumed bits is updated with a number of bits used for encoding the K sets of frequency coefficients of the audio signal for K successive frames preceding the K successive current frames;

wherein transforming the K successive current frames comprises transforming each respective one of the K successive current frames into a frame-type dependent set of frequency coefficients; and further comprising:

classifying each respective one of the K successive current frames based on the presence or absence of an acoustic attack within each respective one of the K successive current frames, and determining the frame-type of each of the K successive current frames based on the classification of the K successive current frames; and wherein the frame-type is one of a short-block type, a long-block type, a start-block type and a stop-type, wherein the short-block type indicates a block having a first number of samples, wherein the long-block type indicates a block having a second number of samples that is a multiple of the first number of samples, wherein the start-block type indicates a first transition block between the long-block type and the short-block type, and wherein the stop-type indicates a second transition block between the short-block type and the long-block type.

20. A method for encoding an audio signal comprising a sequence of frames, the method comprising classifying, using K different hardware processing units respectively in parallel, each of K successive frames of the audio signal based on the presence or absence of an acoustic attack within a respective one of the K successive frames; wherein K>1;

determining, using a hardware microprocessor, a frame-type of each frame k, k=1, . . . , K, of the K successive frames based on the classification of the frame k and based on the frame-type of the frame k−1; and transforming, using the K different hardware processing units respectively in parallel, each of the K successive frames into a respective one of K sets of frequency coefficients, wherein the set k of frequency coefficients corresponding to frame k depends on the frame-type of frame k;

wherein the frame-type is one of a short-block type, a long-block type, a start-block type and a stop-type, wherein the short-block type indicates a block having a first number of samples, wherein the long-block type indicates a block having a second number of samples that is a multiple of the first number of samples, wherein the start-block type indicates a first transition block between the long-block type and the short-block type, and wherein the stop-type indicates a second transition block between the short-block type and the long-block type.

* * * * *